US011565164B2

(12) United States Patent
Hansen et al.

(10) Patent No.: US 11,565,164 B2
(45) Date of Patent: Jan. 31, 2023

(54) RESPONSIVE TRAINING DEVICE

(71) Applicant: iibip ApS, Juelsminde (DK)

(72) Inventors: Anders Hansen, Juelsminde (DK); Toni Marquard, Juelsminde (DK); Jens Dyekjær Madsen, Juelsminde (DK)

(73) Assignee: iibip ApS, Juelsminde (DK)

( * ) Notice: Subject to any disclaimer, the term of this patent is extended or adjusted under 35 U.S.C. 154(b) by 406 days.

(21) Appl. No.: 16/083,203

(22) PCT Filed: Feb. 24, 2017

(86) PCT No.: PCT/DK2017/050050
§ 371 (c)(1),
(2) Date: Sep. 7, 2018

(87) PCT Pub. No.: WO2017/152917
PCT Pub. Date: Sep. 14, 2017

(65) Prior Publication Data

US 2019/0038955 A1 Feb. 7, 2019

(30) Foreign Application Priority Data

Mar. 8, 2016 (EP) ..... 16159078

(51) Int. Cl.
*A63B 71/06* (2006.01)
*A63B 43/06* (2006.01)
(Continued)

(52) U.S. Cl.
CPC ..... *A63B 71/0622* (2013.01); *A63B 21/4037* (2015.10); *A63B 41/125* (2020.08);
(Continued)

(58) Field of Classification Search
CPC ..... A63B 71/0622; A63B 43/00; A63B 43/06; A63B 21/4037; A63B 2225/74;
(Continued)

(56) References Cited

U.S. PATENT DOCUMENTS 4,824,107 A 4/1989 French
4,883,271 A 11/1989 French
(Continued)

FOREIGN PATENT DOCUMENTS

WO WO 01/08755 2/2011

OTHER PUBLICATIONS

International Search Report for International Application No. PCT/DK2017/050050 dated May 9, 2018.
(Continued)

*Primary Examiner* — Robert P Bullington
*Assistant Examiner* — Stephen Alvesteffer
(74) *Attorney, Agent, or Firm* — Dykema Gossett PLLC

(57) ABSTRACT

An exemplary responsive training device for responding to user interaction with the device can be provided. For example, the responsive training device can be configured with a surface enclosing a compressible body. The responsive training device can further embed at least one sensor configured to sense a deformation of the compressible body and to generate a sensory output to a controller. The responsive training device can also embed a controller configured to control at least one transponder. Furthermore, the exemplary responsive training device can embed at least one transponder configured to provide an audio output and/or a visual output as a function of the sensor output.

15 Claims, 9 Drawing Sheets

(51) Int. Cl.
*A63B 21/00* (2006.01)
*A63B 43/00* (2006.01)
*A63B 41/00* (2006.01)

(52) U.S. Cl.
CPC ..... *A63B 43/00* (2013.01); *A63B 43/06* (2013.01); *A63B 2071/0625* (2013.01); *A63B 2220/17* (2013.01); *A63B 2220/40* (2013.01); *A63B 2220/56* (2013.01); *A63B 2220/833* (2013.01); *A63B 2225/74* (2020.08)

(58) Field of Classification Search
CPC ..... A63B 41/00; A63B 2220/833; A63B 2220/17; A63B 2071/0625; A63B 2220/40; A63B 2220/56
USPC ..... 434/247
See application file for complete search history.

(56) References Cited

U.S. PATENT DOCUMENTS 5,280,905 A * 1/1994 Micco ..... A63B 69/345 473/444
5,419,549 A 5/1995 Galloway
7,433,805 B2 * 10/2008 Vock ..... G01P 3/50 235/444
9,943,128 B2 * 4/2018 Atashbar ..... A42B 3/0433
2005/0212762 A1 * 9/2005 Pearcey ..... A63B 69/20 345/156
2006/0252601 A1 * 11/2006 Baum ..... A47C 20/021 482/9
2011/0214501 A1 * 9/2011 Ross ..... A61B 5/6807 73/172
2011/0302694 A1 * 12/2011 Wang ..... A61B 5/103 2/160
2012/0144934 A1 * 6/2012 Russell ..... G01P 1/127 73/862.626
2014/0221137 A1 8/2014 Krysiak et al.
2014/0290360 A1 10/2014 Binder
2015/0113731 A1 * 4/2015 Liu ..... A63B 6/00 5/417
2016/0011091 A1 * 1/2016 Huang ..... G01N 3/24 73/841
2017/0128816 A1 * 5/2017 DeMarch ..... A63B 71/0622
2017/0225032 A1 * 8/2017 Jones ..... A63B 21/065

OTHER PUBLICATIONS

International Written Opinion for International Application No. PCT/DK2017/050050 dated May 9, 2018.

* cited by examiner

5A)

5B)

RESPONSIVE TRAINING DEVICE

CROSS REFERENCE TO RELATED APPLICATION(S)

This application relates to, and claims the benefit and priority from International Patent Application No. PCT/DK2017/050050 filed on Feb. 24, 2017 that published as International Patent Publication No. WO 2017/152917 on Sep. 14, 2017, which claims the benefit and priority from European Patent Application No. 16159078.1 filed on Mar. 8, 2016, the entire disclosures of which are incorporated herein by reference in their entireties.

FIELD OF THE DISCLOSURE

The present disclosure relates to an exemplary responsive training device for responding to the user interaction with such device. The exemplary responsive training device can be configured to include a surface enclosing a compressible body. The exemplary responsive training device can further embed at least one pressure sensor configured to (i) sense deformation of the compressible body and (ii) generate a sensory output in response to pressure applied to the surface to a controller. The exemplary responsive training device can further embed or otherwise include a controller configured to control at least one transponder. Furthermore, the exemplary responsive training device can also embed at least one transponder configured to give an audio-or-visual output as a function of the sensor output.

BACKGROUND INFORMATION

Training, exercise or rehabilitation is a continuous process and a reoccurring routine for many people. A wide range of devices has been developed to assist or strengthen the output of each training pass.

For example, a broad range of interactive training devices which instruct the user in how to perform the exercises have been developed. The interactive portion of such training device can often comprise a screen which displays a pattern that the user has to follow or mirrors the user's movements. By mirroring the user on a screen, the user may adjust the way in which the exercises are performed such that the exercises are performed correctly. By displaying a pattern or an animated figure, the interactive devices may instruct and guide the user through an exercise routine on the number of repetitions to be performed of each training exercise and how fast it should be performed. Hence, the emphasis can be on instructing or guiding the user, and the interaction may comprise a one-way dialogue from the screen to the user in case of the displayed pattern or the displayed mirroring of the user on the screen. In particular, these devices typically require that a screen is connected to the training device, and that it is important for the user to keep focus on the screen for an intentional use of the devices.

Interactive devices without external screens have also been developed in which music or light is a way of communication to or with the user. Such further devices may include devices which instruct the user on an exercise routine by the number of repetitions to be performed of each exercise or how fast the exercise should be performed by playing music with a rhythm corresponding to the rhythm by which the user should perform the exercises. The devices may comprise predefined programs aimed for muscle build-up or cardio-vascular training, where light, music or instructions are provided from the device to the user on which exercises to perform, repetition rate, time left of the program and so forth. The emphasis can often be on instructing the user, and the communication is provided from the machine to the user. Thus, such devices are not interactive with the user, and thus, they do not adapt to the ability of the user due to a one-way communication from machine to user.

International Publication WO 2001/008755 describes an interactive exercise device which combines some of the abovementioned aspects. This publication discloses a substantially flat exercise mat which guides the user according to a predetermined exercise program. If the exercise is not performed correctly, the user is required to start the exercise again, and to initialize the exercise mat.

The exercise mat of such publication comprises a grid with labeled or targeted areas and the user's performance is monitored by use of a grid of capacitance contact sensors to monitor if and which targeted area is activated by the user. Thus, the exercise mat of such publication is basically a binary sensor grid, and the use thereof is for determining if exercises are correctly performed according to a predetermined program. A further feature disclosed in International Publication WO 2001/008755 is to measure the presence of a limb in the close vicinity of the mat for correctly performed exercises. This is achieved by using a capacitance contact sensor with a screen partially around the sensor element, which constrains the spatial construction of the mat.

U.S. Patent Publication No. 2015/0113731 describes another example of the exercise mat. Such mat guides the user to perform certain predetermined exercises. In contrast to International Publication WO 2001/008755, U.S. Patent Publication No. 2015/0113731 describes that the user is guided by sound or light, i.e., the mat lights up the next position of the hand, foot or other limb. The disclosed exercise mat of U.S. Patent Publication No. 2015/0113731 has a built-in sensor which is believed to be a contact sensor. Thus, similar to the mat described in International Publication WO 2001/00875, the disclosed exercise mat of U.S. Patent Publication No. 2015/0113731 is believed to be a binary sensor grid.

U.S. Patent Publication No. 2014/0290360 describes yet another interactive exercise device, i.e., a ball with built-in motion sensor. Such ball arrangement interacts with the user in relation to the detected movement as compared to a built-in logic of how the movement is desired. This exercise device of U.S. Patent Publication No. 2014/0290360 focuses only on movement detection.

Another group of training devices are responsive training devices or athletic equipment with biofeedback. These devices return a device response generated by a user input, and encompass athletic equipment such as a ball responsive to acceleration, club or racquet responsive to applied force by the user, pressure-responsive boxing ball or a ball responsive to impact applied by a user via user's hand or a racquet held thereby. The feedback or response is often presented as numbers submitting measured data for statistical purposes. However, these devices also include certain equipment that returns a sound which the user recognizes as a measure of, for example, applied impact facilitated as one response to one user input. Thus, the devices which respond with numerical output are well suited for statistical purposes, and subsequent evaluation of training passes. However, for in-use purposes, these devices are not well-suited, as the user has to relate to numerical data during the training pass and keep their focus on such information. For devices returning a sound response, the user receives an immediate response to his/her interaction with the device, and may adjust their use of the device immediately. Nonetheless, contrary to the previously-mentioned devices, these devices do not guide or instruct the user on how to proceed or progress further in the remaining training pass. One example may be the sports impact measuring apparatus described in U.S. Pat. No. 4,883,271. The apparatus described in this U.S. patent comprises a deformable resilient support suitable for receiving impacts and means for measuring and indicating a value describing the characteristics of the impact. Such apparatus comprises external visual arrangement for displaying the characteristics of the impact and is particularly suited for measuring the characteristics of blows performed by athletes, and thus a high-impact use, where a response indicating the level of impact is important.

In general, the majority of responsive training devices are developed for users with a basically normal functionality and/or already trained persons, and thus, the use of these devices require a certain level for mobility and physique. A further example of a responsive training device is described in U.S. Patent Publication No. 2014/0221137. The training device described in this publication is designed as an American style football comprising various sensor means for measuring the use of the device, especially the rotation. The device also comprises a pressure sensor particularly for measuring the inflation level of the football device such that the pressure can be adjusted according to the rules of American football. The response is generally given as an optical response, especially light emitting device(s) such that the thrower of the football receives an immediate response to the use thereof.

Additionally, other responsive devices include responsive punching toys, as described in U.S. Patent Publication 2005/0212762, which discloses a toy that responds to a user punch or blow with an audio response. The sensor is a switch-type or piezo type but used as a switch-type sensor. The toy has no training effect and is intended for venting frustration or aggression.

OBJECTS OF PRESENT DISCLOSURE

It is an object of the present disclosure to address and/or overcome one or more of the before mentioned shortcomings of the prior devices. One exemplary object of the present disclosure is to achieve a responsive rehabilitation device for use with a minimum level for mobility and/or physique. A further exemplary object of the present disclosure is to provide a responsive rehabilitation device configured to sense a stimulation suitable for a physical rehabilitation and/or a cognitive rehabilitation.

SUMMARY OF EXEMPLARY EMBODIMENTS

One or more of such objects can be achieved by providing a responsive training device for responding to user interaction with the device according to an exemplary embodiment of the present disclosure. The exemplary responsive training device can be configured with a surface enclosing a compressible body. The exemplary responsive training device can further embed at least one sensor configured to sense deformation of the compressible body, and generate a sensory output to a controller. The exemplary responsive training device can further embed (i) a controller configured to control at least one transponder, and/or (ii) at least one transponder configured to provide an audio output and/or a visual output as a function of the sensor output.

For example, a compressible body can mean that, but not limited to, when applying a temporary force to the device, the device may be deformed, and when releasing the force, the device returns to the shape or form prior to applying force.

A deformation may also be a compression. The sensed deformation may be caused by user interaction. In the following example, user interaction can be used in the sense that a deformation of the compressible body occurs. The deformation may refer to any degree of deformation.

One effect of this exemplary embodiment can be that the responsive training device may be used as an individual training device disconnected from other ways, and thus, no additional equipment has to be connected to the device when it is in use. This can be advantageous in that no installation of additional equipment is required, which saves space and costs associated with such additional equipment. Furthermore, the user does not need special knowledge on how to install additional equipment. A further advantage can be that the exemplary training devices may be used independent from the location, which can be indoor and/or outdoor.

Another effect of this exemplary embodiment can be that during use, the user can limit his/her focus to the equipment due to the audio-or-visual output from the device. This is advantageous so as to reduce the risk of loss of balance during use of the device because the user is changing his/her eye focus. This may be relevant for the elderly and/or feeble users which can certainly benefit from the use of this exemplary device. The audio-or-visual output can also be advantageous for another potential group of users, including visually or hearing impaired persons or even blind or deaf persons.

Generally, the exemplary embodiment can present simple training devices for domestic use which are intuitive in use such that the devices may be used without supervision and continuous instructions. The embodiment presents a device that may be interesting for continuous training and rehabilitation with the advantage of easing the approach to the training devices for a broad user segment. The simple devices may also be interesting in more professional connections for example for instructors, trainers, physiotherapists or others where clients may use the training devises themselves with the advantage that the clients may use the training devises without supervision and continuous instructions.

The term responsive in responsive training devise refers to that the training device reacts to a detected action and responds with an output. The output may be a suggestion of new modes or supporting modes. As an example, new modes may include a change in rhythm of the detected action, or a change in intensity of the performed actions by the user. As an example, supported modes may include responses which support the rhythm and intensity of the user. However, the responsive training may also react or respond to a non-occurring action.

An action may be a deformation of the compressible body.

Audio-or-visual response is a response given as a signalling response as sound or light or sound and light. The audio response or sound response may be a single sound, a combination of sounds, a stanza, or a piece of music. The visual response or light response may be a gleam of light, a flashing light, or different colors of light. The audio-or-visual response may include the above examples alone or a combination of these and is by no means limited to the above examples.

The transponder may comprise several transponders and/or may one or more speakers, one or more light indicators or a combination of both for an audio-or-visual response.

The target group for the training device may include a broad range of users including amongst others very feeble persons, elderly, disabled, people with limitations of their musculoskeletal system, and people without any muscular problems. The device may be used for rehabilitation, routinely training for maintaining muscle and condition level or for improving muscle and condition level.

The training device may furthermore be used for cognitive training or brain training where a physical activity may be a part of the training.

The responsive training devises can be developed to be intuitive in use with a minimum requirement of knowledge to technique, electronics, software or other technical knowledge.

In one exemplary embodiment of the present disclosure, the controller comprised in the responsive training device may be configured to generate a first audio-or-visual output and to generate a second audio-visual output as a function of a sensor output.

One exemplary effect is that the responsive device may give a first audio-or-visual output to a non-occurring action. This is advantageous in regard to alerting the user that it may be time to do the routinely training or instruct the user that a training session is scheduled.

Another exemplary effect is that the responsive device can provide a first audio- or visual output that is not in line with the on-going training. An advantage of this may be to instruct the user to change the training mode or to instruct the user that the required training pass is fulfilled. Another advantage of this is that the user may be alerted of excessive use of the device, which may for example include notification that intensity is too high. This may be a problem during rehabilitation and thus the advantage may be to reduce the risk of excessive muscle load which may lead to further injuries or a set-back in the rehabilitation of muscles, joints and/or tendons.

In one exemplary embodiment of the responsive training device according to the present disclosure, at least one sensor can be or include a pressure sensor, which pressure sensor can be configured to generate a sensory output in response to pressure applied to the surface.

One exemplary effect of this exemplary embodiment of the present disclosure, the training device may be set to be responsive to an applied pressure from the user. This can be advantageous for using the training device to a broad range of exercises. Often, exercises for maintaining or improving muscle and/or condition level includes applying a form of pressure to the device. The exercises may for example include standing exercises in which the user applies pressure simply by stepping onto the device, sitting exercises in which the user varied the pressure of the body to the device, squeezing exercises by which the user squeezes the device with for example his/her fingers, hands, arms, legs, by rolling on the device or other ways.

In one exemplary embodiment of the responsive training device according to the present disclosure, the pressure sensor can be configured with two or more sensor zones, which sensor zones can be configured to generate a sensory zone output in response to where the pressure is applied to the surface.

One exemplary effect of this exemplary embodiment can be that the training device may detect in which zone or zones the pressure is applied. This can be advantageous for performing balancing exercises or for doing right- and left-hand training, where the device may respond according to the intensity of the pressure applied on for example the right-hand side compared to that applied on the left-hand side of the device. Pressure is a measurement of force per area (P=F/A), and thus a further advantage of using sensor zones may be to better determine the actual force performed by the user to the device.

In one exemplary embodiment, at least one sensor can be a capacitive sensor.

In another exemplary embodiment, at least one capacitive sensor comprises a capacitive electrode configured as an electric shield embedding the compressible body.

The exemplary capacitive sensor which may be used in this exemplary device can be a shielded capacitive sensor comprising a two terminal device that can include two or more conducting bodies separated by a dielectric material. The sensor can operate by measuring the capacitance between the two conducting bodies. If the dielectric material and the distance between the two conducting bodies remain constant, the capacitance also remains constant. By introducing a change in distance between the two conducting bodies, the capacitance changes.

Thus, a compression of the dielectric material between the conducting bodies can result in a change in capacitance due to reduced distance. Furthermore, the compression may also change the dielectric properties of the dielectric material and thus both contributions, which may lead in different directions, may contribute to the change in capacitance. The change in capacitance is thus a result of a change in distance and material properties, and therefore, a measurement of the pressure applied to the device.

The dielectric material may excess a counter force to the force applied by the user. This counter force can be considered in the measurements. Furthermore, the sensing capabilities for dielectric materials can be a function of the dielectric constant of the material and the mass of material within the sensing field, which also may change due to compression of the dielectric material. These changes can also be considered in the measurements.

One exemplary effect of using a capacitive sensor is that the sensor may be flexible which may have the advantage that the user does not feel the sensor when using the device. A further exemplary effect is that the sensor may be constructed with a wide range of shapes which is advantageous in regard to easily adapting the sensor to fit the design of the exemplary device.

Another exemplary effect of applying a capacitive electrode as an electric shield embedding the compressible body may be that bodies or things in the close vicinity of the training device which do not cause a deformation in the compressible body are not detected. Thus, e.g., in this exemplary embodiment, only when a force is exerted on the responsive training device, an action can be sensed. This may be advantageous in cases where a person passes by the device, or if there are unintentional movements in the close vicinity of the device as such cases will not be registered as a performed exercise. Thus, in this exemplary embodiment, e.g., only user interactions causing a deformation, i.e., exerting force to the device, are registered with the advantage that the intentional use of the device as a training device per se can be fulfilled.

In one exemplary embodiment of the responsive training device according to the present disclosure, at least one capacitive sensor can comprise at least one capacitive sensor layer configured with two or more sensor zones.

As previously herein, one exemplary effect of this exemplary embodiment can be that the training device may detect in which zone or zones the pressure is applied. This can be advantageous for performing balancing exercises or for doing right- and left-hand training where the device may respond according to the intensity of the pressure applied on for example the right-hand side, compared to that applied on the left-hand side of the device.

A further exemplary effect of an exemplary embodiment using at least one capacitive sensor, e.g., the exemplary sensor can comprise at least one capacitive electrode configured as an electric shield embedding the compressible body, and the exemplary sensor can also comprise a capacitive sensor layer configured with two or more sensor zones, is that the one capacitive sensor may be used for both the pressure sensor and the position sensor. The advantage of this exemplary embodiment, where the sensor comprises a capacitive sensor layer configured with two or more sensor zones, can be that only the one sensor is needed to be embedded in the device.

In one exemplary aspect, the capacitive sensor may comprise at least one capacitive sensor electrode configured by a conductive fabric.

In another aspect, the capacitive sensor according to the exemplary embodiment of the present disclosure may comprise at least one capacitive sensor electrode configured by at least one conductive thread sewed or woven into a material.

In yet another exemplary aspect, the capacitive sensor according to the exemplary embodiment of the present disclosure may comprise at least one capacitive sensor electrode configured by a surface of a conductive spray-on material.

In still another exemplary another aspect, the capacitive sensor according to the exemplary embodiment of the present disclosure may comprise at least one capacitive sensor electrode configured by at least one unshielded electrical lead embedded in the device.

One exemplary effect of these exemplary aspects can be that the sensor may be performed as part of the device. This can be advantageous to easily adapting the sensor to fit the design of the device. A further exemplary advantage can be that the sensor may be adapted to the individual designs of the device and furthermore, the sensors may be sewed, woven, assembled or sprayed into the device as one additional simple procedure operation amongst the procedure operations of the complete production procedure of the device. Further, this exemplary additional procedure operation may not require any specialized technological knowledge of the production personnel. Furthermore, the acts of for example sewing a conductive thread into a material, thereby constituting one capacitive sensor electrode may be incorporated in the working routine as other parts of the product can also include sewing procedures and thus, a single person may handle several of the acts acquired in the production of one product.

Another exemplary effect can be that the sensors are fabricated using simple means as thread, fabric or spray. This can be advantageous in regard to the fact that not specific electronic devices are necessary and thus the production of the device is independent of subcontractors of sensors. A further exemplary advantage is that the costs may be reduced using simple exemplary arrangement, such as thread, fabric or spray compared to prefabricated electronic sensors.

In one exemplary embodiment, the responsive training device can comprise at least one additional sensor in form of an accelerometer.

One exemplary effect of this exemplary embodiment can be that the responsive training device may be used to detect the motion of the device. This may be an advantage when using the device for coordinative exercises. Using an accelerometer can broaden the use of the training device to detect if the device is elevated, rotated, thrown, dropped, swung or used for exercises involving other movements.

In one exemplary embodiment, the responsive training device can be formed as a pillow, a ball or a mat.

The effect of this exemplary embodiment can be that the device may be shaped according to well-known training devices with the advantage of easing the approach of the user to the device. A further exemplary advantage can be that the device may be used for exercises which are already well-known by the user from other training devices. Furthermore, the well-known forms of a pillow, a mat and a ball may favour a natural approach to the device and thus an intuitive use of the exemplary device.

The form of the pillow may include for example a cubic form, a cylinder form, a triangular shape or a device shaped like a seat. The form of the pillow is by no means limited to these examples.

The ball may be a big ball used for floor exercises, a small ball for throwing or lifting or any size in between.

The matt may be in full body size for support during lying exercises, smaller mats for using up against a wall or smaller matts in feet size of for standing exercises or any size in between.

The form of the exemplary responsive training device is not limited to the above mentioned examples.

The invention is primarily developed for training purposes in the broad sense already described. However, the invention may also be used in connection with psychological therapy, for intelligent physical games, as a toy or for other purposes not mentioned here.

In one exemplary embodiment of the responsive training device according to the exemplary embodiment of the present disclosure, the pressure sensor can detect applied pressure characteristics of at least intensity, repetition rate, rhythm or combinations thereof.

As examples, the exemplary repetition rate may comprise the number of repetitions of applied pressure, intensity may comprise the strength of pressure applied, the duration of applied pressure or a combination of these, rhythm may comprise the pattern of applied pressure.

In one exemplary aspect of the responsive training device according to the exemplary embodiment of the present disclosure, the sensory output can be classified according to a set of pressure characteristics mapped to a set of response characteristics output as an audio-or-visual response.

In another exemplary aspect of the responsive training device according to the exemplary embodiment of the present disclosure, the sensory output can be further categorized according to a set of movement characteristics mapped to the set of response characteristics.

The exemplary effect of this exemplary embodiment can be that the use of the device can be detected and may be categorized accordingly. This may be advantageous in regard to the further use of the exemplary device, as the use of the device can be adaptable to the user and such that the response from the device takes origin in the user's abilities. Furthermore, the exemplary response may be mapped to the input of the user to motivate or instruct the user to continue the training using the device.

In one exemplary aspect the responsive training device can, when in use, respond with an audio-visual signal configured with an audio-or-visual universe responsive to the pressure characteristics of the use, motion characteristics of the use or combinations thereof.

An audio-or-visual universe may, for example, comprise a type of music, a light pattern which expresses a feeling, a state of mind, resemble scenery from nature or present the user to other sceneries or universes of sound or light or a combination of these. The sceneries from nature could for example be bird song, sunrise or waves. A state of mind could for example be relaxed, meditative or gearing up.

The effect of a response in form of an audio-or-visual universe may be that the device can be configured or adapted to the user's preferences in music and light with the advantage of using universes which motivate the user to use the device and to continue using it.

Music may be used for stimulating senses or to recreate memories, and thus selecting a particular music universe for the device may give the use a further aspect in the use of the device.

A universe of sound may also be the sound of a particular instrument. One exemplary effect of this may be that the device can be configured or adapted to the user's preferences in music as described above. Another exemplary effect may be that multiple devices may be used simultaneously and in vicinity of each other with the advantage that the single devices can be distinguishable, and thus consequently the use of the single device. This may be beneficial if multiple people are training together.

In one exemplary aspect, the responsive training device according to the exemplary embodiment of the present disclosure may comprise a near field communication unit. One exemplary effect may be that when multiple devices are used simultaneously and in vicinity of each other, they may communicate together. This may be advantageous for adjusting the sound of the single devices to be distinguishable from each other or the contrary. Alternatively, the sound of the single devices may be adjusted such that the devices form a music ensemble.

In one exemplary embodiment, the responsive training device according to the exemplary embodiment of the present disclosure may be configured with at least three additional sensors in form of an accelerometer, a gyroscope and a compass. The effect of this exemplary embodiment is that the position of device may be determined thereby achieving that displacement of the device may be the user interaction.

One of the objects of the present disclosure may be achieved by a method according to an exemplary embodiment of the present disclosure of achieving a responsive training device configured with a surface by performing an act of implementing sensor means into an item configured with the surface, in which the exemplary training device comprises at least one pressure sensor configured to sense deformation of the compressible body and to generate a sensory output in response to pressure applied to the surface to a controller. The exemplary training device further comprises a controller configured to control at least one transponder. The exemplary responsive training device furthermore comprises least one transponder configured to give an audio-or-visual output as a function of the sensor output. The exemplary training device motivates the user through the audio-or-visual response.

The exemplary effects and advantages of this exemplary embodiment have been described herein. A further exemplary effect may be achieved using an existing training device. This can be advantageous in regard to adapting the users own devices, according to the exemplary embodiments of the present disclosure, or adapting devices well-known to the user, according to the exemplary embodiments of the present disclosure, to a responsive training device. Thus, existing devices may be adapted to be within the scope of the exemplary embodiments of the present disclosure compared to prior art by producing an audio- or visual response as a function of applied pressure, applied motion or a combination of both.

In one exemplary aspect of the exemplary embodiments of the present disclosure, the audio-or-visual universe may be altered through wireless data transmission to the controller.

In another exemplary aspect of the exemplary embodiments of the present disclosure, the compressible body can comprise an elastic and dynamic material which reacts to both weak and heavy pressures.

In yet another exemplary aspect of the exemplary embodiments of the present disclosure, the compressible body can comprise an elastic and dynamic material which does not collapse or experience material fatigue due to continuous use.

In still another exemplary aspect of the exemplary embodiments of the present disclosure, the responsive training device may exclude control panels, buttons or sockets.

In a further exemplary aspect of the exemplary embodiments of the present disclosure, the responsive training device can comprises one or more rechargeable power units, and the device may be rechargeable via a docking station connected through an electrically conductive fabric on the surface or cover of the device, via solar panels, via magnetic connections or via other means which may be comprised on the surface or embraced in the device.

According to an additional exemplary aspect of the exemplary embodiments of the present disclosure, the responsive training device can comprise a hygienic surface or cover, and/or an anti-slip surface or cover.

The aspects described above and further aspects, features and advantages of the present disclosure may also be found in the exemplary embodiments which are described in the following with reference to the appended drawings and claims.

BRIEF DESCRIPTION OF THE DRAWINGS

Further exemplary embodiments of the present disclosure are detailed in the description of the Figures, where this description shall not limit the scope of the present disclosure. The Figures show.

Figure 1:
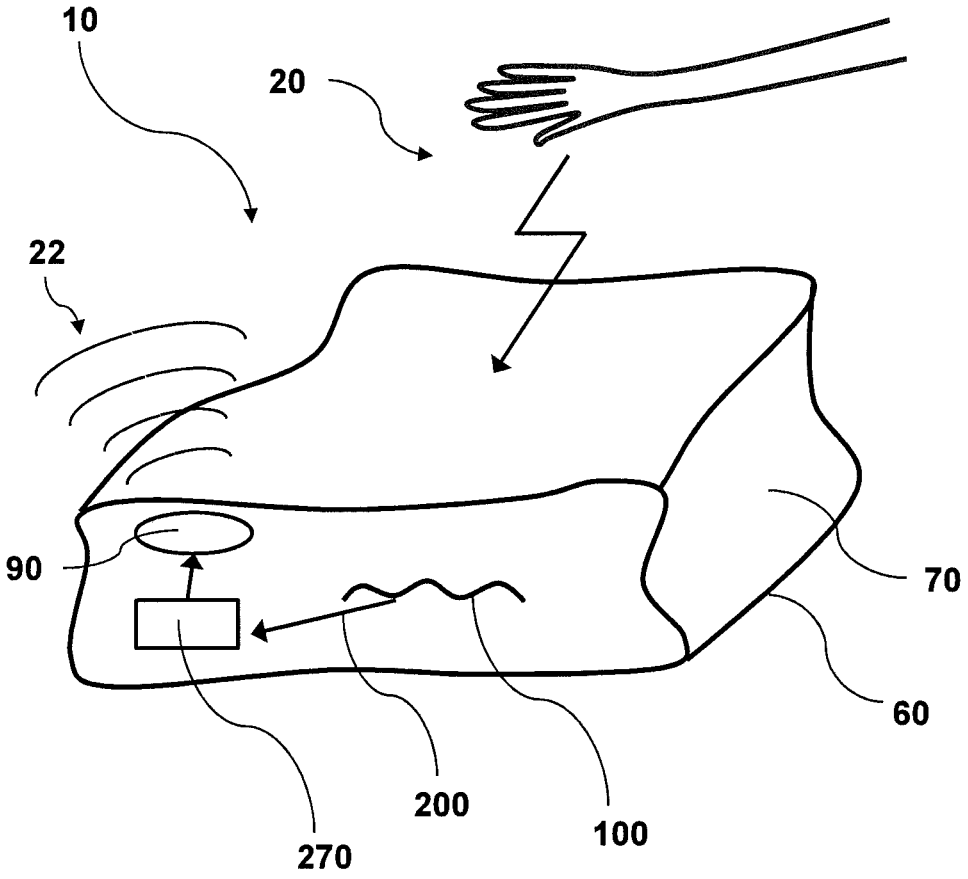
FIG. 1 illustrates the responsive training device with user interaction as applied pressure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure as defined by the appended claims.

DETAILED DESCRIPTION OF EXEMPLARY EMBODIMENTS

FIG. 1 illustrates a diagram of a responsive training device 10 according to an exemplary embodiment of the present disclosure with user interaction 20. The user interaction 20 may be a pressure applied by the user to the device 10. As shown in FIG. 1, the pressure is indicated as applied by hand to the surface 60 of the device 10. Due to the applied pressure, the compressible body 70 of the device 10 is compressed. A sensor 100 embedded in the device 10 detects the user interaction 20 and generates a sensor output 200. The sensor output 200 is received by the controller 270. The controller 270 controls a transponder 90 which gives an audio-or-visual output 22.

Figure 2:
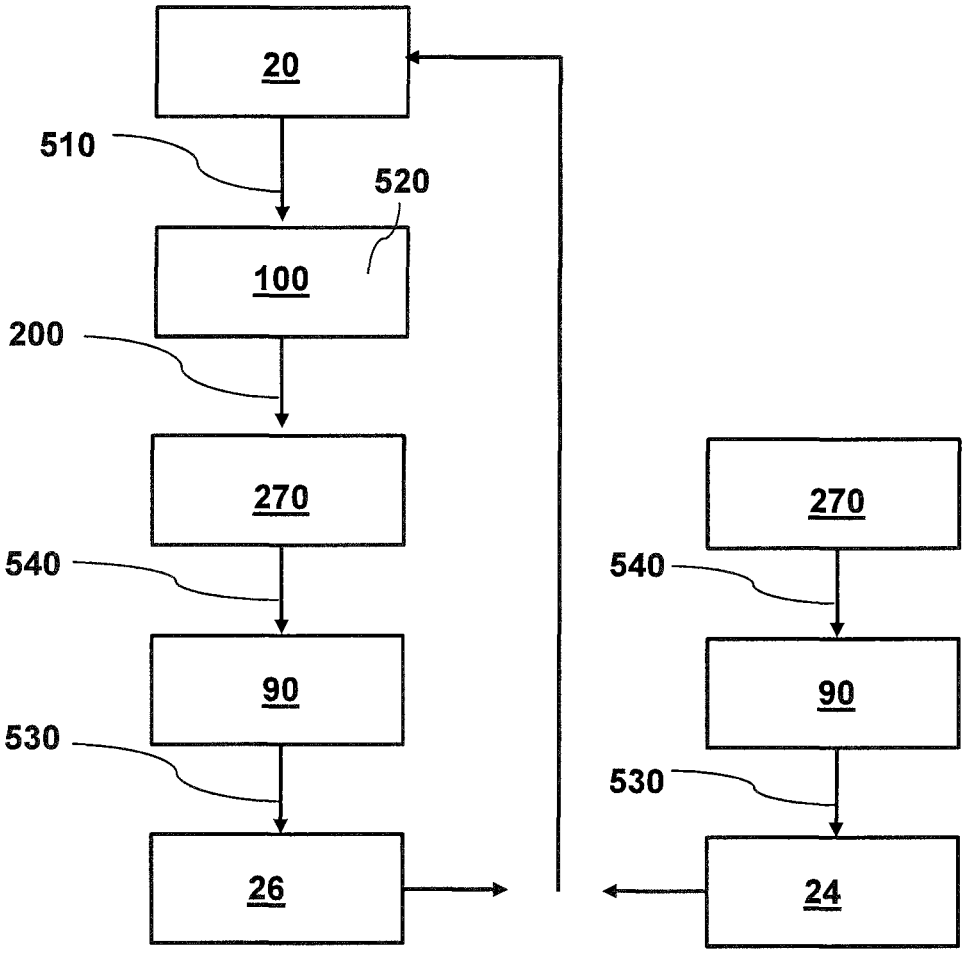
FIG. 2 illustrates the response of the responsive training device with a first and a second audio-or-visual response.

FIG. 2 illustrates a flow diagram of a procedure of how a response of the responsive training device 10 can be generated with a first audio-or-visual response 24 and a second audio-or-visual response 26, according to an exemplary embodiment of the present disclosure. For example, the first audio-or-visual response 24 is generated by the controller 270 without a sensory output 200 and without user interaction 20. The controller 270 controls 540 the transponder 90 to output 530 an audio-or-visual signal, which for this embodiment is the first audio-or-visual output 24. The first audio-or-visual output 24 may alert or motivate the user to use the training device 10. The user may then interact 20 with the device and apply 510 a pressure or a movement to the device 10. This interaction can be detected 520 by a sensor 100 which generates a sensor output 200. The sensor output 200 can be forwarded to the controller 270, which controls a transponder 90 to output 530 an audio-or-visual signal, which—for this exemplary embodiment—can be the second audio-or-visual output 26.

The exemplary illustration of FIG. 2 can provide several working modes of the device 10 where the device 10 is set to alert, instruct, or motivate the user by a first audio-or-visual response 24. For example, the working mode may be to alert the user to begin a training routine. Another example may be that the working mode of the device 10 is set to motivate the user to alter the pattern of the on-going training.

Figure 3:
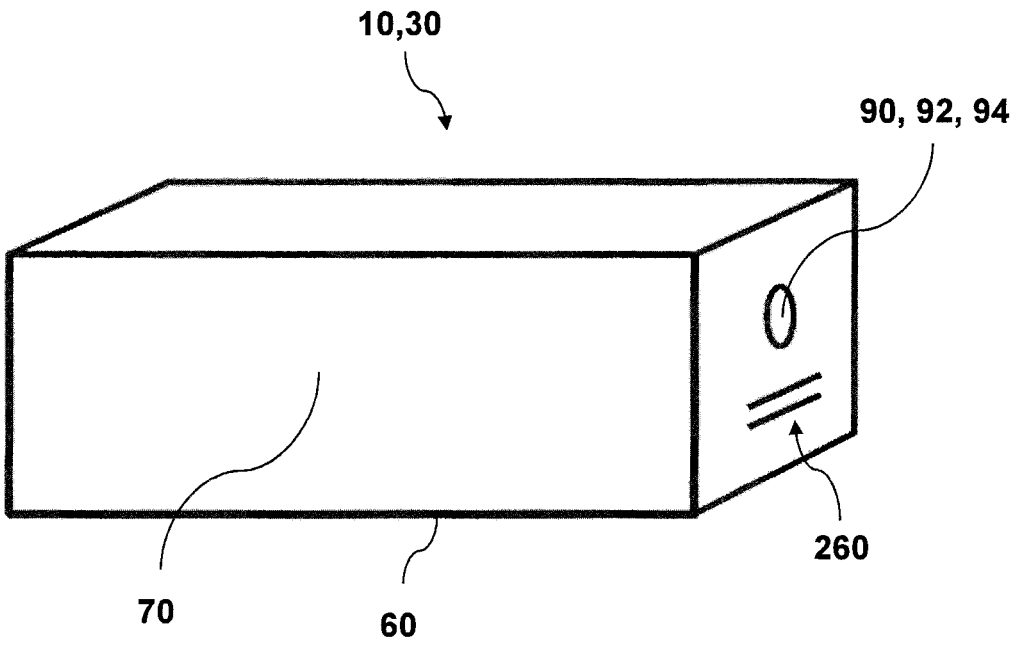
FIG. 3 illustrates the invention in the form of a pillow.

FIG. 3 illustrates perspective view of the exemplary responsive training device 10 formed as a pillow 30, according to another exemplary embodiment of the present disclosure. The exemplary device 10 can be configured with a surface 60 enclosing a compressible body 70 embedding a transponder 90 and which surface 60 is configured with a connecting point 260. The connecting point 260 may, for example, be useable for recharging the device 10 by connecting the device 10 to a docking station. Another example for use of a connection point can be to load or alter the audio-or-visual universe 28 of the device 10. The illustrated transponder 90 may comprise several transponders 90 and may comprise one or more speakers 92, one or more light indicators 94 or a combination of both for an audio-or-visual response 22.

Figure 4:
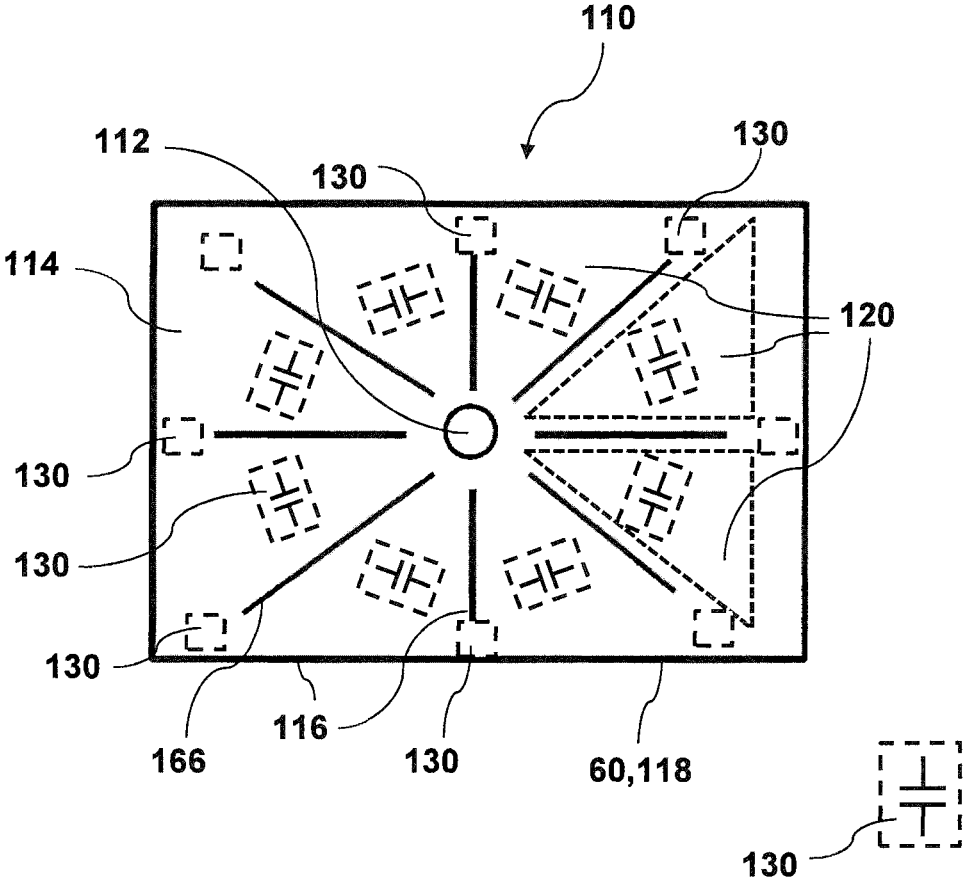
FIG. 4 illustrates a top section view of a capacitive sensor comprising a capacitive sensor layer.

FIG. 4 illustrates a top section view of a capacitive sensor 110 which may be embedded in the responsive training device 10, according to an exemplary embodiment of the present disclosure. The sensor 110 can comprise two conductive bodies configured as a capacitive sensor layer 114 and as an electric shield 118. In the illustrated exemplary embodiment of FIG. 4, the electric shield further constitutes the surface 60 of the device 10. The capacitive sensor layer 114 can be configured with multiple capacitive electrodes 116 which may be conductive threads 166 woven into or sewed onto a non-conductive fabric. The capacitive electrodes 116 can divide the sensor into multiple sensor zones 120. The capacitance 130 may be measured between any of the capacitive electrodes 116, e.g., between the electric shield 118 and the capacitive electrodes 116 comprised in the capacitive sensor layer 114. The capacitive sensor 110 can further comprise a capacitive sensor chip 112.

Due to the compressible body 70 of the exemplary device 10, the distance between the capacitive electrodes 116, including the electrode constituting the electric shield 118, can be changed when an outside pressure is applied to the device 10. As the distance and material density of the elastic material 72 between the electrodes 116 is changed, the capacitance 130 between the electrodes 116 can be altered. The change in capacitance 130 may be registered by the capacitive sensor chip 112. The sensor zones 120 can facilitate the possibility of generating sensory zone outputs 210 in response to the location of where the pressure is applied to the device 10.

Figure 5:
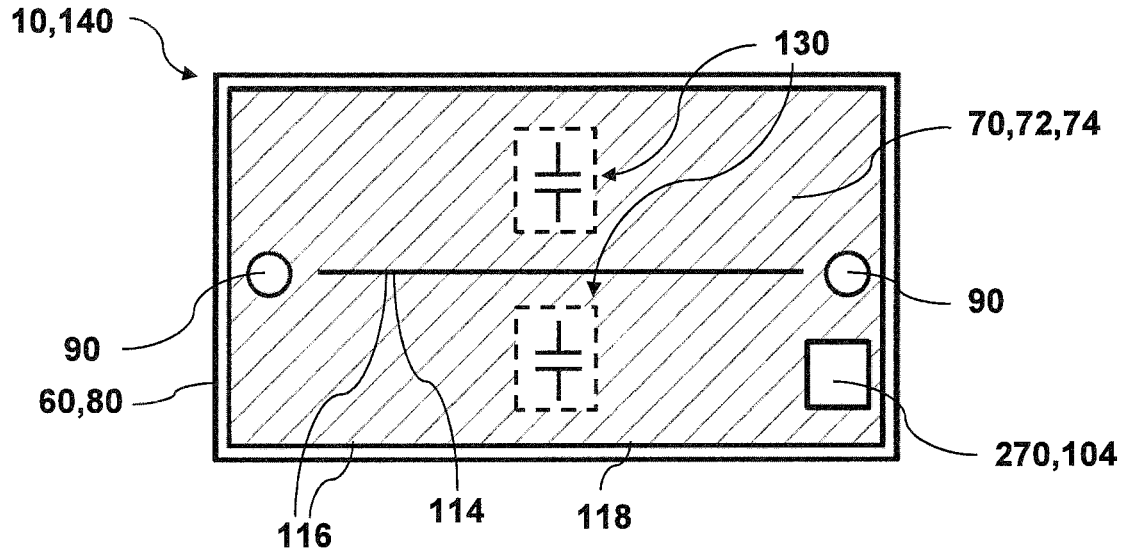
FIG. 5 illustrates a side section view of a capacitive sensor embedded in the responsive training device. 5A: one-part capacitive sensor, 5B: two-part capacitive sensor.
Figure 5:
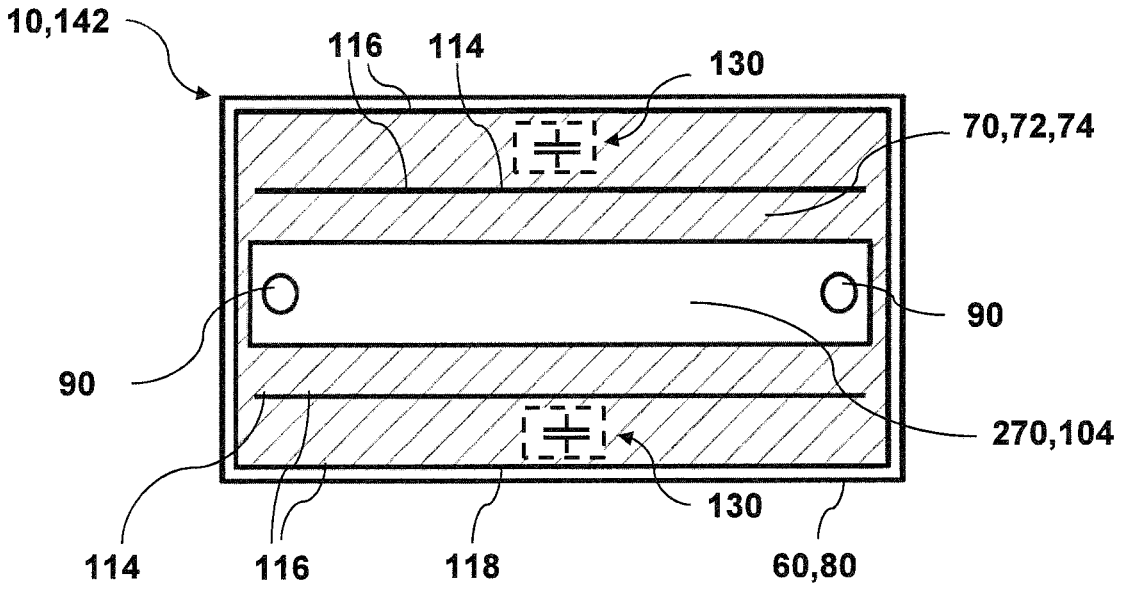

FIGS. 5A and 5B illustrates side section views of a capacitive sensor 110 embedded in the responsive training device 10, according to an exemplary embodiment of the present disclosure. The surface 60 of the illustrated embodiment of FIGS. 5A and 5B can comprise a cover 80.

In particular, FIG. 5A shows an exemplary one-part capacitive sensor 140. The one-part capacitive sensor 140 can comprise a capacitive electrode 116 placed substantially in the middle between the upper and lower part of the device 10, which for this exemplary embodiment can also be in the middle between the upper and lower part of the electric shield 118, comprising the other capacitive electrode 116. The capacitive electrode 116 in the middle of the device 10 may comprise a capacitive sensor layer 114 outlined with sensor zones 120 as illustrated in the top section view in FIG. 4. As described herein in connection with FIG. 4, due to the compressible body 70 of the device 10, the capacitance 130 between the capacitive electrodes 116 can be changed when an outside pressure is applied to the device 10. In the training device 10, two transponders 90 and a controller 270 can be embedded to generate an audio-or-visual response 22 generated by an applied pressure. Furthermore, an accelerometer 104 can be embedded in the device.

FIG. 5B shows an exemplary two-part capacitive sensor 142. This exemplary sensor can comprise two capacitive sensor electrodes embedded in the compressible body 70 surrounded by the electric shield 118 constituting yet another capacitive electrode 116. For example, the two capacitive sensor electrodes embedded in the compressible body 70 can be placed substantially parallel to each other with one placed above the middle of the device 10 and the other placed below the middle of the device 10. Thus, a kernel of the device 10 is left available for embedding transponders 90, a controller 270 and an accelerometer 104. The two capacitive sensor electrodes embedded in the compressible body 70 may be capacitive sensor layers 114 configured with the outline illustrated in the top section view in FIG. 4.

Figure 6:
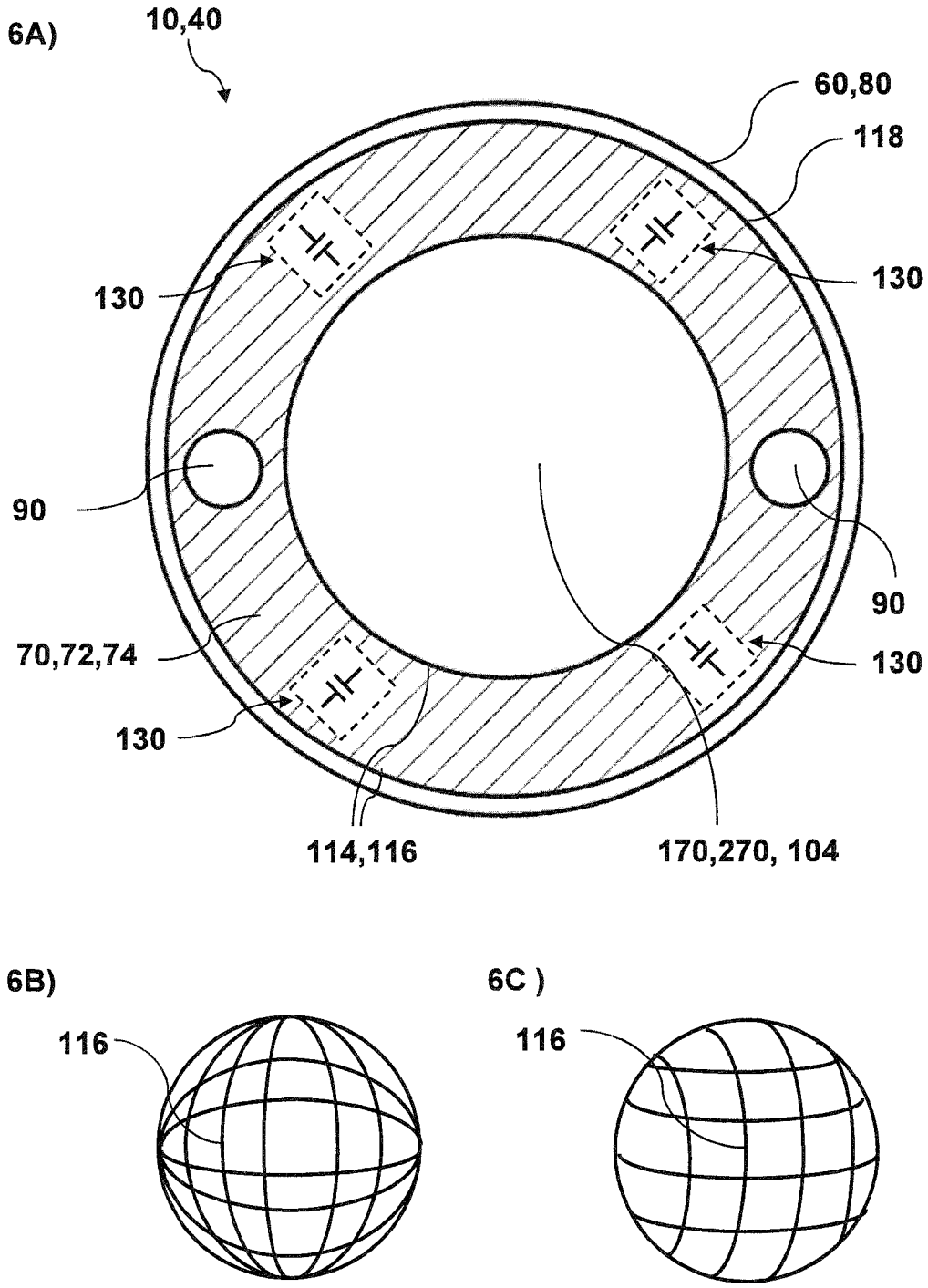
FIG. 6 illustrates a section view of a capacitive sensor embedded in a ball-formed responsive training device.

The responsive training device 10 constructed as a ball 40 according to another exemplary embodiment of the present disclosure is illustrated in FIG. 6A as a cross-sectional view thereof. In particular, FIG. 6A shows the ball-forming training device 10,40 comprising a capacitive sensor 110 and an accelerometer 104. The capacitive sensor 110 can comprise annular capacitive electrodes 116 in an inner layer and an outer layer with substantially equidistance spaced along the circumference of the ball. The electrodes 116 may be thin ring-shaped capacitive electrodes, broader band-shaped electrodes configured as a capacitive sensor layer 114 or ball-shaped capacitive sensor layers 114. The sensor layers 114 may further be outlined with sensor zones 120 resembling the capacitive sensor layer 114 illustrated in FIG. 4. Furthermore, the capacitive electrode 116, in one layer, may comprise multiple thin ring-shaped capacitive electrodes or broader band-shaped electrodes placed at different angles or distances to each other as illustrated in FIGS. 6B and 6C.

The two capacitive electrode layers 114 are spaced by a compressible body and as previously described in connection with FIG. 4 the capacitance 130 between the layers 114 or across the sensor zones 120 comprised in the individual layers 114 may be changed due to an applied pressure to the surface 60 of the ball-formed device 10,40. In the centre of the ball 40 comprised within the inner layer of the capacitive sensor a controller 240 may be embedded. The centre of the ball may comprise an incompressible fluid or a compressible fluid. If a compressible fluid is embedded in the centre of the ball, considerations should be taken regarding the degree of compressibility of the two compressible materials comprised in the device 10 to achieve sufficient changes in capacitance in order to determine the applied pressure.

The surface 60 of the illustrated embodiment comprises a cover 80.

Figure 7:
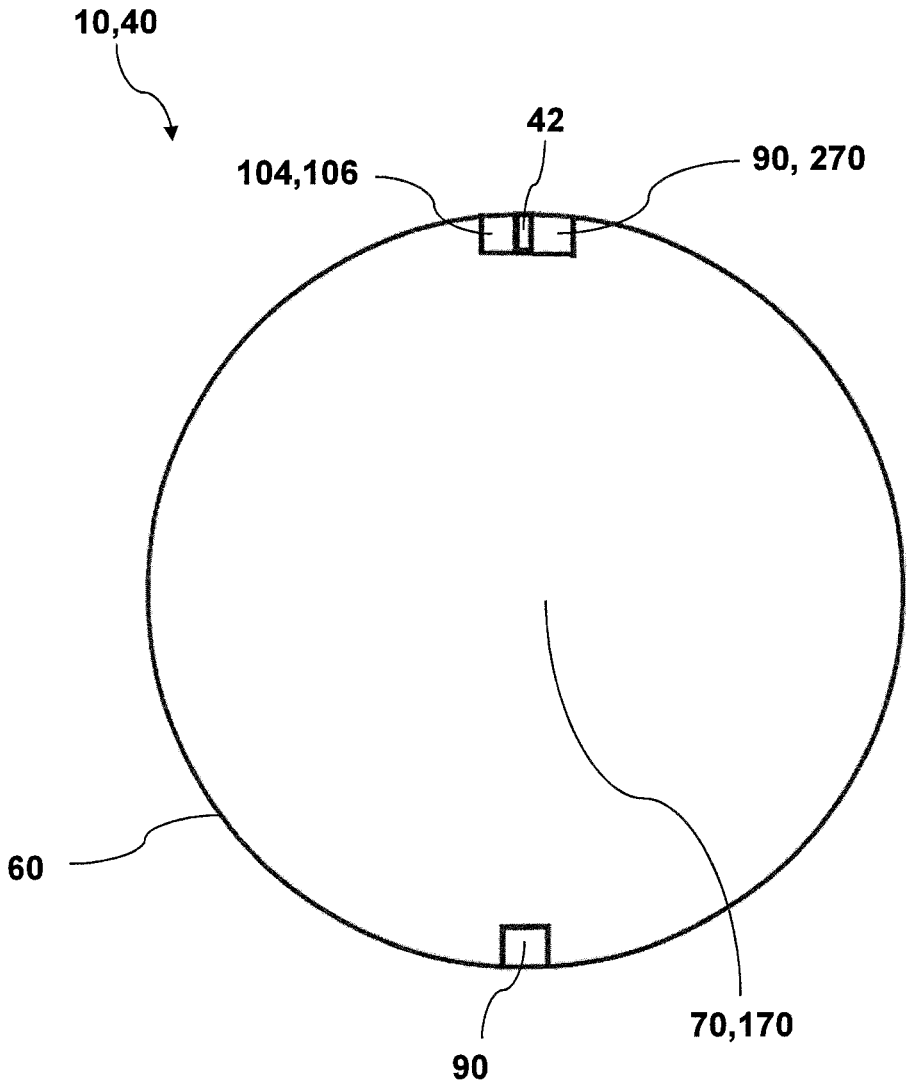
FIG. 7 illustrates a section view of air pressure sensor embedded in a ball-formed responsive training device.

FIG. 7 illustrates a sectional view of the responsive training device 10 constructed as a ball 40 according to yet another exemplary embodiment of the present disclosure. As shown in FIG. 7, the exemplary embodiment of the training device comprises an air pressure sensor 106 and an accelerometer 104 embedded in the ball with the surface 60. The ball comprises a centre of air 170 which also constitutes the compressible body 70. A valve 42 is provided to inflate the ball 40. Furthermore, two transponders 90 and a controller are embedded in the ball to generate an audio-or-visual response.

Figure 8:
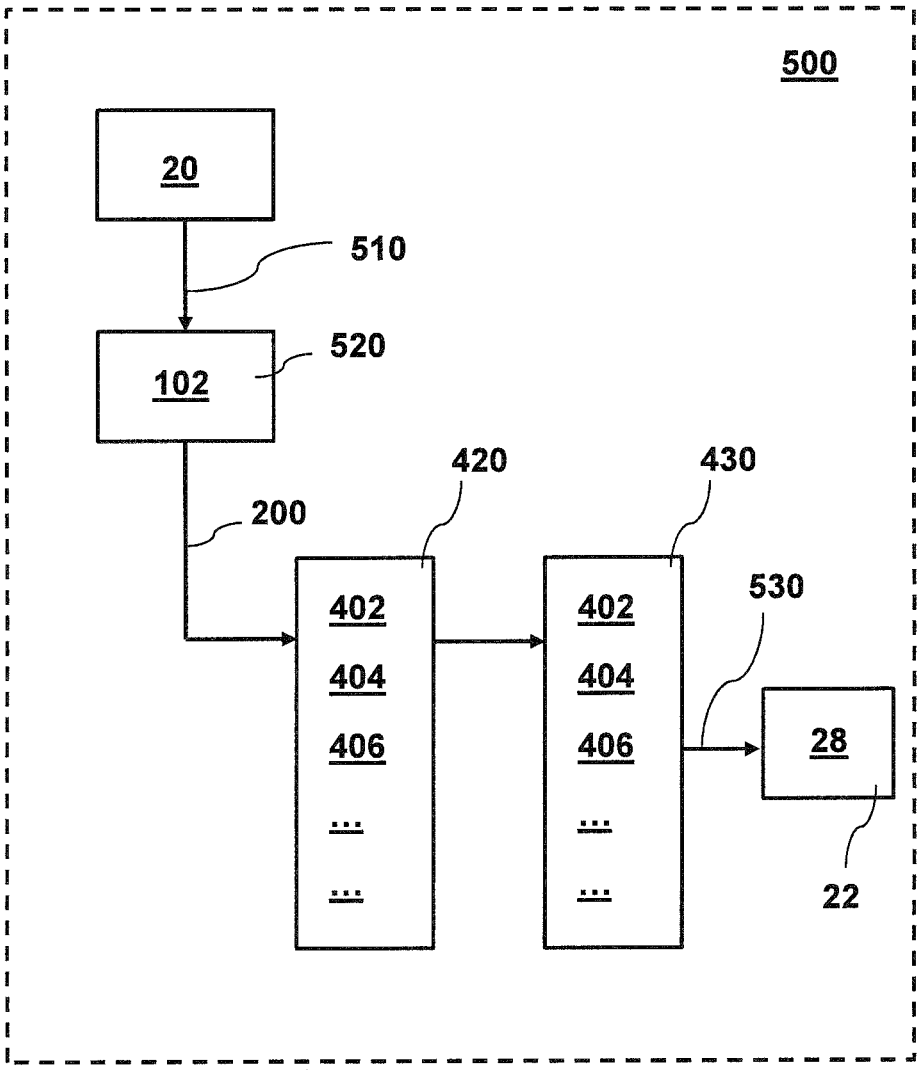
FIG. 8 illustrates the response of the device in use, in which the response is generated by a user pressure input.

FIG. 8 illustrates a flow diagram of a procedure indicating an exemplary response of the responsive training device 10 in use 500. For example, the response can be generated by a pressure input due to user interaction 20. As shown in FIG. 8, the user can interact with the device 10 by applying 510 a pressure to the device 10. The applied pressure can be detected 520 by a pressure sensor 102 and the sensory output 200 is classified according to a set of pressure characteristics 420. The pressure characteristics 420 can be mapped to a set of response characteristics 430. The set of response characteristics 430 can be mapped to a specific audio-or-visual universe 28 which can be an output 530 as an audio-or-visual response 22. The set of pressure characteristics 420 may comprise information such as intensity 402, repetition rate 404 and rhythm 406 of the applied pressure.

Figure 9:
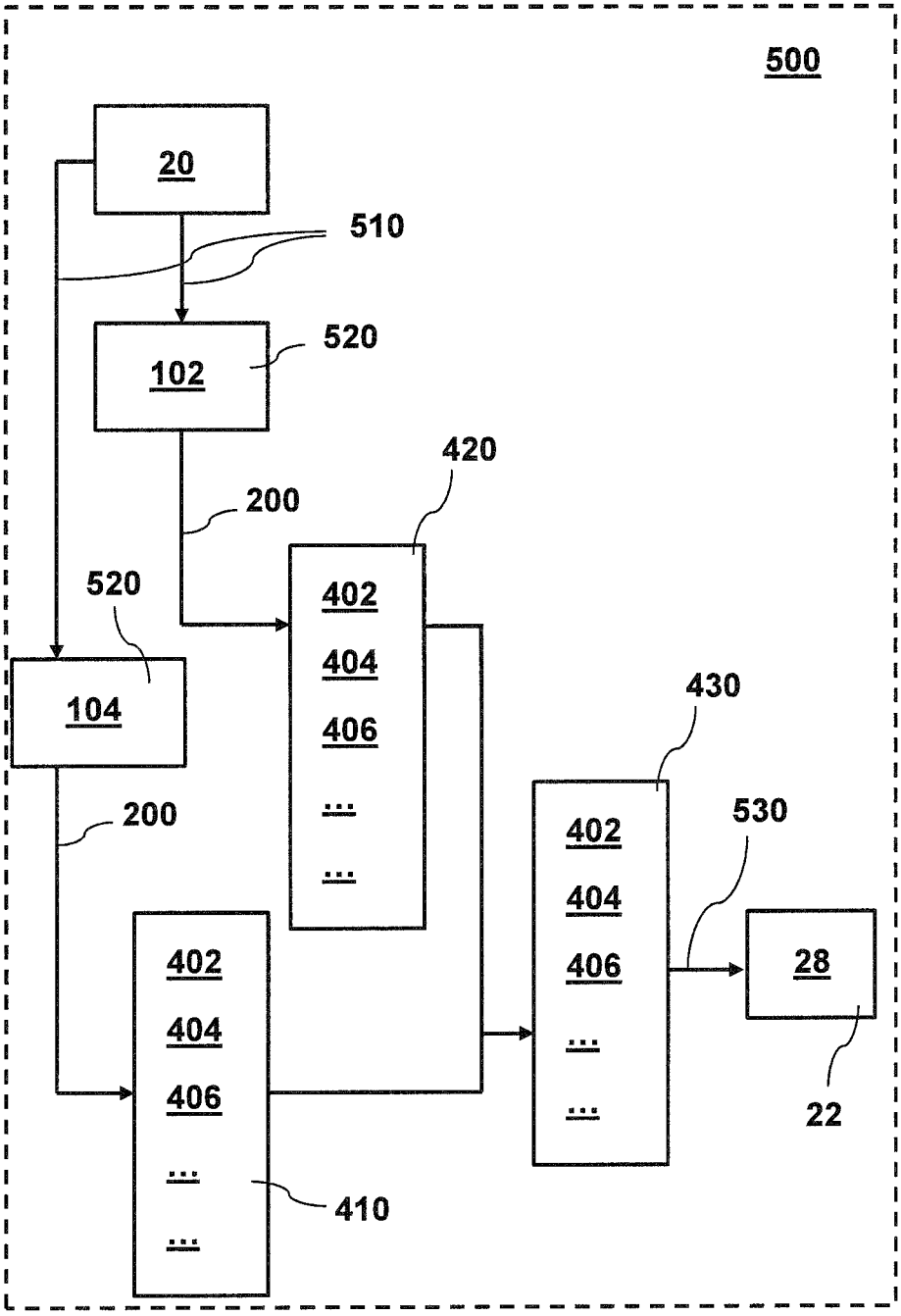
FIG. 9 illustrates the response of the device in use, in which the response is generated by a user pressure input and a user movement input.

FIG. 9 illustrates a flow diagram of another procedure indicating an exemplary response of the responsive training device 10 in use 500, whereas the response can be generated by a pressure input and a motion input due to user interaction 20. As shown in FIG. 9, the user can interact with the device 10 by applying 510 a pressure and motion to the device 10. The applied 510 pressure can be detected 520 by a pressure sensor 102, and the applied 510 motion can be detected 520 by an accelerometer 104. The sensor outputs 200 can be classified according to a set of pressure characteristics 420 and a set of motion characteristics 410. The characteristics 410,420 can be mapped to a set of response characteristics 430. The set of response characteristics 430 can be mapped to a specific audio-or-visual universe 28 which is output 530 as an audio-or-visual response 22. The set of pressure and motion characteristics 410,420 may comprise information such as intensity 402, repetition rate 404 and rhythm 406 of the applied pressure.

EXEMPLARY LIST OF REFERENCE SIGNS

| No | Item |
|---|---|
| 10 | Responsive training device |
| 20 | User interaction |
| 22 | Audio-or-visual response |
| 24 | First Audio-or-visual response |
| 26 | Second Audio-or-visual response |
| 28 | Audio-or-visual universe |
| 30 | Pillow |
| 32 | Pillow, cubic cross section |
| 34 | Pillow, round cross section |
| 36 | Pillow, triangular cross section |
| 40 | Ball |
| 42 | Valve |
| 50 | Mat |
| 60 | Surface |
| 70 | Compressible body |
| 72 | Elastic material |
| 74 | Dielectric material |
| 80 | Cover |
| 90 | Transponder |
| 92 | Speaker |
| 94 | Light indicator |
| 100 | Sensor |
| 102 | Pressure sensor |
| 104 | Accelerometer |
| 106 | Air pressure sensor |
| 110 | Capacitive sensor |
| 112 | Capacitive sensor chip |
| 114 | Capacitive sensor layer |
| 116 | Capacitive sensor electrode |
| 118 | Electric shield |
| 120 | Sensor zone |
| 130 | Capacitance |
| 140 | One-part capacitive sensor |
| 142 | Two-part capacitive sensor |
| 160 | Conductive material |
| 162 | Conductive spray-on material |
| 164 | Conductive fabric |
| 166 | Conductive thread |
| 170 | Air |
| 200 | Sensor output |
| 210 | Sensor zone output |
| 260 | Connecting point |
| 270 | Controller |
| 280 | Power unit |
| 290 | Memory unit |
| 400 | User characteristic |
| 402 | Intensity |
| 404 | Repetition rate |
| 406 | Rhythm |
| 408 | Rotation |
| 410 | Movement characteristic |
| 420 | Pressure characteristic |
| 430 | Response characteristic |
| 500 | Use |
| 510 | Apply |
| 520 | Detect |
| 530 | Output an audio-or-visual signal |
| 540 | Control |
| 542 | Process |

The invention claimed is:

1. A responsive rehabilitation device for responding to a user interaction therewith, the responsive rehabilitation device being in the form of a compressible body comprising:

a surface enclosing the compressible body;

a controller positioned centrally within the compressible body;

at least one pressure sensor configured to sense a deformation of the compressible body in response to a pressure applied to the surface and to generate a quantitative sensor output to the controller in response to the pressure applied to the surface;

at least one transponder positioned inside the compressible body, the at least one transponder configured to provide at least one of an audio output, a visual output or a combination thereof as a function of the quantitative sensor output; and wherein the controller is configured to control the at least one transponder as a function of the quantitative sensor output, wherein the at least one pressure sensor is a capacitive sensor including at least two conducting bodies separated by the controller and a dielectric material, wherein the two conducting bodies are placed substantially parallel to each other on each side of the controller, the capacitive sensor is configured for measuring change in capacitance between said at least two conducting bodies, said change in capacitance is a result of a change in distance between the at least two conducting bodies, and converting the measured change in capacitance to the quantitative sensor output.

2. The responsive rehabilitation device according to claim 1, wherein the at least one pressure sensor is configured to generate the quantitative sensor output in response to a continuously applied pressure to the surface.

3. The responsive rehabilitation device according to claim 1, wherein the at least one pressure sensor is configured with two or more sensor zones which are configured to generate a sensor zone output in response to a location on the surface of where the pressure is applied.

4. The responsive rehabilitation device according to claim 1, wherein the capacitive sensor comprises a capacitive electrode which provides for an electric shield that embeds the compressible body.

5. The responsive rehabilitation device according to claim 1, wherein the capacitive sensor comprises at least one capacitive sensor electrode provided as a conductive fabric.

6. The responsive rehabilitation device according to claim 1, wherein the capacitive sensor comprises at least one capacitive sensor electrode provided as at least one conductive thread sewed or woven into a material.

7. The responsive rehabilitation device according to claim 1, wherein the capacitive sensor includes at least one capacitive sensor electrode is a second surface generated by a conductive spray-on material.

8. The responsive rehabilitation device according to claim 1, further comprising at least one further sensor which is an accelerometer.

9. The responsive rehabilitation device according to claim 8, further comprising at least two further sensors which include a gyroscope and a compass.

10. The responsive rehabilitation device according to claim 1, wherein the responsive rehabilitation device is a pillow or a ball.

11. The responsive rehabilitation device according to claim 1, wherein the at least one pressure sensor detects applied pressure characteristics of at least one of an intensity, a repetition rate, a rhythm, or a combination thereof.

12. The responsive rehabilitation device according to claim 11, wherein, when in use, the responsive rehabilitation device responds with at least one signal which is at least one of the audio output, the visual signal or the combination thereof, and wherein the at least one signal configured with at least one of an audio universe, a visual universe responsive or a combination thereof to at least one of the set of pressure characteristics of the use, motion characteristics of the use, or combinations thereof.

13. The responsive rehabilitation device according to claim 1, wherein the quantitative sensor output is classified according to a set of pressure characteristics mapped to a set of response characteristics which are outputted as a response which is at least one of the audio output, the visual output or the combination thereof.

14. The responsive rehabilitation device according to claim 13, wherein the quantitative sensor output is further categorized according to a set of movement characteristics mapped to the set of response characteristics.

15. The responsive rehabilitation device according to claim 13, wherein, when in use, the responsive rehabilitation device responds with at least one signal which is at least one of the audio output, the visual signal or the combination thereof, and wherein the at least one signal configured with at least one of an audio universe, a visual universe responsive or a combination thereof to at least one of the set of pressure characteristics of the use, motion characteristics of the use, or combinations thereof.

* * * * *